United States Patent [19]

Rühle

[11] 4,210,193

[45] Jul. 1, 1980

[54] METHOD OF PRODUCING AN ALUMINUM-SILICON CASTING

[75] Inventor: Martin Rühle, Stuttgart, Fed. Rep. of Germany

[73] Assignee: Mahle GmbH, Stuttgart, Fed. Rep. of Germany

[21] Appl. No.: 905,329

[22] Filed: May 12, 1978

[30] Foreign Application Priority Data

Jun. 22, 1977 [DE] Fed. Rep. of Germany ..... 2728048

[51] Int. Cl.² ..... B22D 27/20; B22D 15/00

[52] U.S. Cl. ..... 164/4; 164/126; 164/131

[58] Field of Search ..... 164/4, 60, 98, 107, 164/122, 125-128, 154, 348

[56] References Cited

U.S. PATENT DOCUMENTS

| | | | |
|---|---|---|---|
| 3,515,546 | 6/1970 | Greenewald | 164/122 X |
| 3,931,847 | 1/1976 | Terkelsen | 164/154 X |
| 3,939,895 | 2/1976 | Sawyer | 164/60 |

FOREIGN PATENT DOCUMENTS

| | | | |
|---|---|---|---|
| 49-16017 | 4/1974 | Japan | 164/60 |
| 1337731 | 11/1973 | United Kingdom | 164/126 |

*Primary Examiner*—Robert D. Baldwin
*Attorney, Agent, or Firm*—James C. Wray

[57] ABSTRACT

An aluminium-silicon alloy casting in which zones formed so as to have a particularly fine-grained structure are cooled by way of individual thin-walled mould wall portions, which are prevented from dissolving completely by the melt and are intermetallically bonded to the casting and are detachable from the finished casting only in a destructive manner.

5 Claims, 1 Drawing Figure

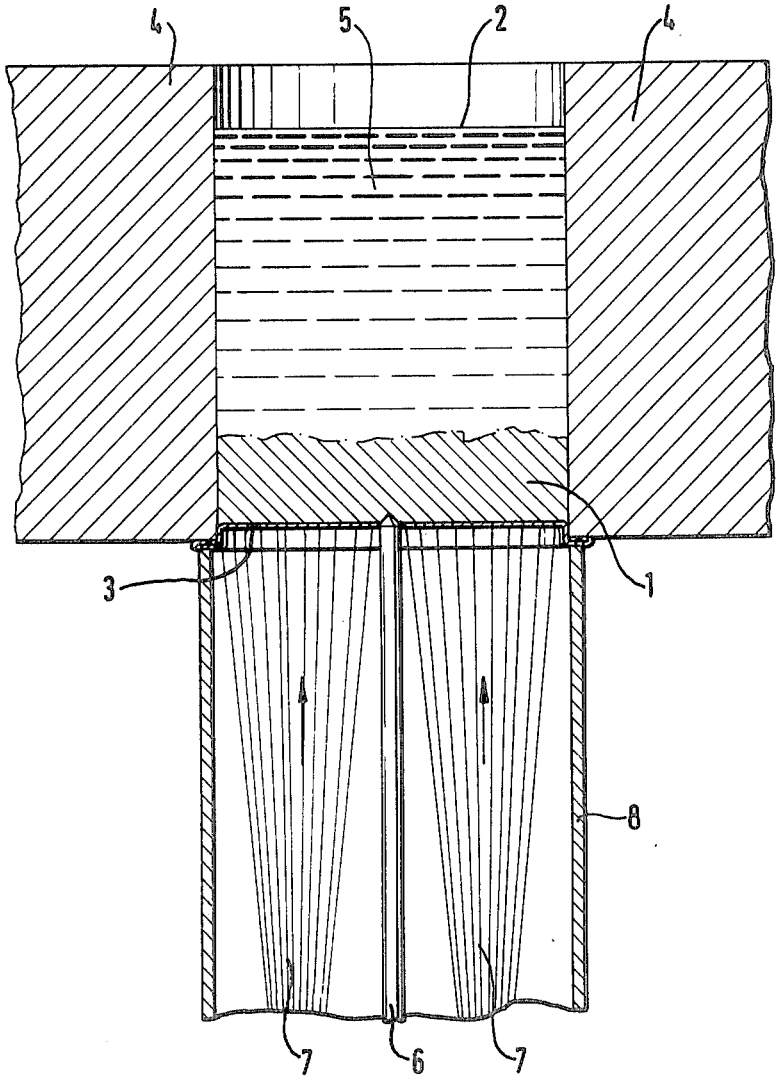
4
5
2
4
3
1
8
7
6
7

METHOD OF PRODUCING AN ALUMINUM-SILICON CASTING

BACKGROUND OF THE INVENTION

1. Field of the Invention

This invention relates to a method for the production of a casting made of an aluminum-silicon alloy.

In aluminum-silicon castings, it is frequently desired to bring about a particularly fine-grained structure, at least at individual specific regions thereof. The fine-grained structure produces in a workpiece of this material characteristics of low thermal expansion, high tensile strength, and high resistance to fatigue. These characteristics may be achieved by annealing the finished casting which effects coagulation of the grains.

2. State of Prior Art

In aluminum-silicon castings silicon inclusions are not present in the form of separate particles but are interconnected by a dendritic network. In the event of the structural zone being externally loaded or deformed, this results in high peak stresses in the silicon which, even if the deformations are only relatively small, cause the brittle silicon inclusions to break and thus internal notches to be introduced into the material. The destruction of these unsuitable networks has so far only been possible by extremely long coagulation annealing of the castings. Such a method is described, for example, in German Patent Specification No. 12 34 399.

In order to obtain fine-grained structural zones in shaped castings, it is already known from British Patent Specification No. 1,337,731 to cool the wall areas of the casting in the molten state thereof by spraying water against the mould walls surrounding the casting. Such a measure causes the grain of the structure to become indeed smaller but only to a relatively narrowly limited extent. This is due to the fact that the solidifying melt shrinks in the mould, causing the contact between the mould wall and the casting to be lost and an air gap to be formed between the mould wall and the casting. This considerably reduces the heat transfer from the casting to the cooling medium, which has the effect that the heat required for the formation of a particularly fine-grained structure can no longer be removed from the casting to a sufficient extent.

OBJECTS OF THE INVENTION

It is the object of the invention to provide an improvement in this respect. It is of particular importance that a fine-grained structure should be brought about during casting, in specific zones of the casting, so that the length of the above-mentioned coagulation annealing, which is necessary for the attainment of specific properties in the material, is shortened as much as possible. A start is made from the known circumstance that extremely fine-grained structures require only extremely short coagulation annealing times.

SUMMARY OF THE INVENTION

According to the invention there is provided a method of casting an aluminum-silicon casting to achieve at least one localized fine-grain region comprising providing a mold to receive the molten metal, providing at least one thin sheet adjacent the region of the resulting casting where fine-grain is required, the inner surface of said sheet defining with the mold walls the shape of the resulting casting, the thickness of the sheet having been predetermined to ensure against complete disintegration of the latter due to the melt, pouring the metal into the mold and effecting a bond between the thin sheet and the metal of the melt, applying a cooling medium to the outer surface of said sheet, allowing solidification, and thereafter removing the sheet by breaking the intermetallic bond between the sheet and the casting.

By means of the invention it is possible to bring about, in any desired individual areas in the mould wall, a fine-grained formation of the eutectic silicon whose linear grain diameter is less than 1.5 $\mu$m. Casting zones provided with such structural areas only require coagulation annealing times of between 10 seconds and 1 hour at temperatures of between 480° C. and 540° C. The method according to the invention is particularly advantageous with respect to a subsequent coagulation of the fine-grained structural area. However, it is not confined only to the present application, but can be used wherever local portions of a shaped casting are to be rapidly and intensively cooled with the aid of a fluid cooling medium.

Further according to the invention there is provided a method including the steps of effecting application of the cooling medium until solidification occurs in the region adjacent the thin sheet, reducing the flow of cooling medium to cause an increase in temperature due to the remaining melt, which increase permits coagulation within the solidified region adjacent the sheet, and thereafter controlling the temperature of the solidified region at the temperature at which coagulation occurs by adjustment of the flow of cooling medium.

The advantage of this performance of the method resides in the fact that coagulation annealing, which has usually to be effected on the finished casting in an additional operation, is dispensed with or is replaced by the selective control of the cooling of the casting.

BRIEF DESCRIPTION OF THE DRAWINGS

The drawing shows a casting, including a fine-grained structural zone, as well as the associated mould.

DESCRIPTION OF THE PREFERRED EMBODIMENT

The casting 2 is to have a fine-grained structure in zone 1. The dimensions of the cylinderical casting 2 are a diameter of 120 mm and a length of 180 mm. The depth of the fine-grained structural zone 1 is 20 mm. The end wall of the mold 4 is formed by a 0.2 mm thick tin sheet 3 along the region that is adjacent the fine-grained structural zone. The fastening of the tin-plate 3 is effected in that, when the mold is closed, it is located by means of a rim and is clamped in position by a hollow cylindrical jacket 8. The composition of the molten material 5 introduced into the mold 4 is: 12% Si, 1% Ni, 1% Cu, 1% Mg and less than 0.7% Fe, with the balance aluminum.

The tin-plate 3 effects a metallic bond to the solidifying melt. If other metal sheets are used, it may be necessary to produce in advance this property for the formation of a metallic bond between the sheet and the solidifying melt by the application of an intermediate layer.

The mold 4 is not cooled.

The tin-plate 3, which covers a cooling area of 100 $cm^2$ (unit area), is cooled for a period of 50 seconds by a stream of water 7 of 50 liters/min.

The finished casting is removed from the mould 4 together with the tin-plate 3 bonded thereto. The portion of the casting 1 which is located above the tin sheet 3 has at a depth of 20 mm a structure of a linear grain diameter of the eutectic Si of less than 1.5 μm. Coagulation annealing of the casting 2 for 1 hour at 500° C. causes the material in the fine-grained structural zone 1 to have the following characteristics:

Ultimate breaking strength: 320 $N/mm^2$ at 20° C.
Breaking elongation: 3.5% at 20° C.; 30.2% at 300° C.
Fatigue strength: 140 $N/mm^2$ at 20° C.

The metallic bond between the solidified melt 1 and the inserted sheet 3 as well as the flexibility of the sheet 3 are to ensure an optimum heat transfer from the melt 5 to the cooling medium 7. If the sheet 3 were lifted from the solidifying melt 1, an insulating gap would be formed, which would as a rule no longer allow the heat to be dissipated sufficiently quickly.

While the casting 2 is being cast, the temperature in the zone which is located in the interior of the mold 4 above the sheet insert 3 and is to receive a fine-grained structure is measured with the aid of a conical sheathed thermocouple 6 at a depth of 10 mm above the sheet 3 and the cooling flow 7 is then controlled in accordance with the determined temperatures. When the solidifying temperature of 575° C. falls by approximately 100° C., cooling is stopped until the zone has been heated up again to approximately 540° C. by the heat from the adjoining melt. Thereupon the cooling flow 7 is controlled according to the temperature determined in the interior so that the zone 1 to be coagulated is kept at the temperature of 540° C. for a period of 15 seconds. Subsequently, cooling is continued by means of the cooling stream 7 until the final solidification of the casting 2. Once the coagulation of the fine casting portion 1 has been effected, the thermocouple 6 is withdrawn from the casting 2. It is also possible to control the cooling process by measuring the surface temperature or by time programming.

After cooling the tin-plate is removed from the casting by destruction of the tin-plate sheet.

The casting zone provided with the structure which has been coagulated in this manner according to the invention has the following characteristics:

Ultimate breaking strength: 300 $N/mm^2$ at 20° C.
Breaking elongation: 3.5% at 20° C.

I claim:

1. A method of producing an aluminum-silicon casting having at least one localized fine-grain region comprising:

(a) providing a mold to receive the molten metal, said mold having an opening at a region where a fine-grain is required in the casting, (a) providing a hollow member to contain a coolant, said member being open at one end, (c) providing at least one thin metal sheet adjacent the region of the resulting casting where fine-grain is required, so as to close said opening, the inner surface of said sheet defining with the mold walls the shape of the resulting casting, the thickness of the sheet having been predetermined to ensure against complete distintegration of the latter due to the melt, said sheet having its mold surface made of a metal which will bond with aluminum-silicon, said sheet being separate from said hollow member, (d) clamping said sheet against the mold by said hollow member, (e) pouring molten aluminum-silicon metal into the mold whereby the metal effects a bond with the thin sheet, (f) applying a cooling medium in said hollow member to the outer surface of said sheet, (g) allowing solidification, and thereafter (h) removing the sheet from the casting by destruction of the sheet.

2. A method according to claim 1, wherein the step of cooling is effected by a stream of water directed in said hollow member against the outer surface of the sheet.

3. A method according to claim 1, wherein a thermocouple is placed in contact with the sheet, by which thermocouple the temperature of the region adjacent the sheet is determined for the purpose of controlling the flow of cooling water.

4. A method of producing an aluminum-silicon casting having at least one localized fine-grain region comprising:

(a) providing a mold to receive the molten metal, (b) providing at least one thin metal sheet adjacent the region of the resulting casting where fine-grain is required, the inner surface of said sheet defining with the mold walls the shape of the resulting casting, the thickness of the sheet having been predetermined to ensure against complete disintegration of the latter due to the melt, (c) pouring molten aluminum-silicon metal into the mold whereby the metal effects a bond with the thin sheet, (d) applying a cooling medium to the outer surface of said sheet, (e) allowing solidification, and thereafter (f) removing the sheet from the casting by destruction of the sheet, said step (e) including the steps of effecting application of the cooling medium until solidification occurs in the region adjacent the thin sheet, reducing the flow of cooling medium to cause an increase in temperature due to the remaining melt, which increase permits coagulation within the solidified region adjacent the sheet, and thereafter controlling the temperature of the solidified region at the temperature at which coagulation occurs by adjustment of the flow of cooling medium.

5. A method as claimed in claim 1 wherein the thin metal sheet has a surface of tin which bonds with the casting.

* * * * *